US006537676B1

(12) United States Patent
Flynn et al.

(10) Patent No.: US 6,537,676 B1
(45) Date of Patent: Mar. 25, 2003

(54) WATERPROOFING MATERIAL AND METHOD OF FABRICATION THEREFOR

(75) Inventors: Bryan N. Flynn, Merseyside (GB); Glyn C. Carter, South Wirral (GB)

(73) Assignee: Rawell Group Holdings Limited, Merseyside (GB)

( * ) Notice: Subject to any disclaimer, the term of this patent is extended or adjusted under 35 U.S.C. 154(b) by 671 days.

(21) Appl. No.: 09/093,185

(22) Filed: Jun. 8, 1998

Related U.S. Application Data

(63) Continuation-in-part of application No. 08/786,102, filed on Jan. 17, 1997, now abandoned, which is a continuation of application No. 08/393,018, filed on Apr. 19, 1995, now abandoned.

(30) Foreign Application Priority Data

Aug. 26, 1992 (GB) ..... 9218178
May 10, 1993 (GB) ..... 9309586

(51) Int. Cl.[7] ..... E02D 31/00

(52) U.S. Cl. ..... 428/454; 428/500; 428/213; 106/607; 156/94; 156/382; 501/146; 501/148

(58) Field of Search ..... 501/146, 148; 106/425, 487, 607, DIG. 4; 264/37; 156/94, 281, 382; 428/500, 213, 454; 427/97

(56) References Cited

U.S. PATENT DOCUMENTS

| | | | |
|---|---|---|---|
| 2,277,286 | A | 3/1942 | Bechtner |
| 3,772,893 | A | 11/1973 | Eilers |
| 4,501,788 | A | 2/1985 | Clem |

(List continued on next page.)

FOREIGN PATENT DOCUMENTS

| | | | |
|---|---|---|---|
| EP | 0 059 625 | B1 | 7/1985 |
| EP | 0 160 448 | B1 | 11/1985 |
| EP | 0 327 382 | | 8/1989 |
| EP | 0 246 311 | B1 | 2/1991 |
| EP | 0 278 419 | B1 | 4/1992 |
| EP | 0 490 529 | A1 | 6/1992 |
| GB | 2 030 155 | A | 4/1980 |
| GB | 2 202 185 | B | 10/1990 |
| WO | WO 94/05863 | * | 3/1994 |

OTHER PUBLICATIONS

Makoto Ogawa et al., "Preparation of Montmorillonite–polyacrylamide Intercalation Compounds and the Water Absorbing Property," 1989, Clay Science 7, pp. 243–251; Dept. of Applied Chemistry, School of Science and Engineering, Waseda Univ., Ohkubo 3, Shinjuku–ku, Tokyo 169, Japan.

In Young Park et al., "Preparation of Nickel Aluminum Double Hydroxides from Hexaamminenickel (II) Complex Solution," 1989, Clay Science 7, pp. 253–259; Department of Applied Chemistry, Waseda Univ., Shinjuku–ku, Tokyo 169, Japan.

R.H. Dowdy et al., "Alcohol–Water Interactions on Montmorillonite Surfaces, I. Ethanol," dated Nov. 29, 1967; pp. 259–271; Dept. of Soil Science, Michigan State Univ., East Lansing, MI.

Cation–Dipole Interactions in Clay Organic Complexes, K.K. Bissada et al., Clay Minerals (1967) 7, pp. 155–166; Department of Earth Sciences, Washington Univ., St. Louis, MO.

G.W. Brindley, "Ethylene Glycol and Glycerol Complexes of Smectites and Vermiculites," Clay Minerals (1966) 6, pp. 237–259.

*Primary Examiner*—D. Lawrence Tarazano
(74) *Attorney, Agent, or Firm*—Oliff & Berridge, PLC

(57) ABSTRACT

A waterproofing material free of loose particulate material comprising a waterproofing sheet formed by extrusion under vacuum from a substantially homogeneous, deformable mass consisting of a mixture of particulate smectite clay and liquid.

25 Claims, 3 Drawing Sheets

U.S. PATENT DOCUMENTS 4,534,925 A 8/1985 Harriett
4,859,723 A 8/1989 Kyminas et al.
5,021,094 A 6/1991 Brown et al.
5,116,413 A 5/1992 Nooren
5,132,021 A 7/1992 Alexander
5,237,945 A 8/1993 White
5,725,942 A * 3/1998 Starita et al. ..... 428/327

* cited by examiner

WATERPROOFING MATERIAL AND METHOD OF FABRICATION THEREFOR

This application is a continuation-in-part of Ser. No. 08/786,102 filed Jan. 17, 1997 now abandoned, which is a continuation of Ser. No. 08/393,018 filed Apr. 19, 1995 now abandoned.

TECHNICAL FIELD

This invention relates to a waterproofing material suitable for waterproofing ponds, lakes, lagoons or comparable sites whereby water is retained, or wherein waste is deposited and the ground beneath has to be protected against leakage of aqueous or other liquid. The material can also be used in relation to water proofing structures, covering contaminated land to prevent flow of water into such contaminated land and lining trenches which separate contaminated areas from clear areas. The material can also be used as roofing material on flat or sloping roofs.

PRIOR ART

Several materials have been proposed in the past which include a layer of swellable smectite such as montmorillonite and/or saponite incorporated within the material to act as the sealing agent. The montmorillonite has been carried by a support layer or base which has been provided in various ways. A support layer acts as protection but also gives additional strength within the material.

European patent number 59625 (CLEM) describes a waterproofing material which is a laminate comprising a fabric base, particles of montmorillonite adhered to the base and a scrim adhered over the montmorillonite particles to retain them on the base.

In European patent application 246 311 (McGROARTY) a lower sheet comprises a base and montmorillonite and an overlaid sheet comprises a base and montmorillonite. The bases are of solid plastics non-venting and impermeable material so one of the bases forms a non-water transmissive layer between the two layers of montmorillonite, thus giving a very good seal. However, the McGROARTY construction does have several practical difficulties. Firstly, the bases are made from a thick, impervious and essentially solid plastics material, described in the specification as HDPE (high density polyethylene). Secondly, the granules of montmorillonite are adhered not only to the base but also to each other.

Waterproofing materials of this kind are usually supplied in rolls and have to be unrolled and placed to lie in the pond, lagoon or storage space. With the bases made from HDPE the McGROARTY material is less flexible than when using a fabric (non-woven or woven) for the base. This means that the product is much more difficult to handle and the montmorillonite is likely to crack during folding and unfolding. Further, because of the nature of an HDPE plastic sheet the adhering of the montmorillonite to its surface is not easy. Quite large quantities of very strong glue have to be used.

A further waterproofing barrier material is disclosed in GB 2 202 185 (NAUE) in which a layer of montmorillonite is sandwiched between a pair of layers of non-woven textile material and the two layers are united by needling, the needles passing through the layer of montmorillonite and uniting all three layers. Again, because the montmorillonite is not adhered to the layers, as the material is unfolded, folded and manhandled during installation, the montmorillonite can move relative to the two layers leaving voids and/or more permeable thinner areas in the montmorillonite layer.

There is a further disadvantage in that all these earlier materials tend to use particulate montmorillonite which may be from 2–5 mm, usually about 3 mm in size. Although finer material can be poured to fill gaps between the larger granules, such larger size granules tend to make up the bulk of the montmorillonite layer in the waterproofing material. As the waterproofing material is only relatively thin, for example containing only perhaps one or two layers of montmorillonite granules, problems can arise in connection with foreign bodies in the montmorillonite used. In its natural state montmorillonite is found alongside shale and other impurities. Whilst the montmorillonite can be quite highly purified, it is not unusual for a low percentage of shale particles to remain in the final sized and graded montmorillonite. An unfortunate result of the use of relatively large granules of montmorillonite is that granules of impurities can also become incorporated in the material. The chemical nature of shale and some other impurities have the effect that not only are they not montmorillonite (and therefore do not swell upon contact with water), but, when wetted, act to inhibit swelling in adjacent montmorillonite granules. Thus, a single granule of shale in a layer of waterproofing material can form a small area (perhaps 10 mm in diameter) which does not swell upon being contacted with water. Such areas are generally water impermeable, but medium and larger such areas allow water to pass through the sheet. When water pressure is high this flow can cause significant wash out of adjacent montmorillonite leading to failure of the sealing system. Although the percentage of impurities is small, and although the failure rate is small, when a large area is sealed using sheet material incorporating such impurities it needs only a single leak for the whole system to have failed. A pond or lagoon which has a single leak is no pond or lagoon at all!

U.S. Pat. No. 2,277,286 (Bechtner) is primarily concerned with formation of a blanket of dry "in-situ" bentonite which has all the disadvantages noted above, and is also difficult to distribute evenly. However, it also mentions the possible formation of a putty-like mass form 50–60% water and 40–50% clay, which is sufficiently cohesive to adhere to rough or smooth surfaces, such as a wall which is to be sealed against leakage from outside earth.

Particulate montmorillonite has also been mixed with various organic components to form a thick putty (see U.S. Pat. No. 4,534,925). Typical components are polypropene and polybutene. This material has been extruded in the form of rods and sheets, usually being stored between layers of release paper. Such material has been used for sealing ground foundations and similar structures. It has not, however, being extruded so as to become united with a carrier sheet and be capable of use in large rolls for covering large areas. Indeed, the polypropene and polybutene used is intended deliberately to give the extruded material a rubbery or formable consistency enabling it to be moulded by hand around small areas such as chimneys, at joints in concrete panels, or where drains penetrate foundations. These materials are also quite expensive and prohibitively so for use in relation to large area sheets.

U.S. Pat. No. 5,116,413 (Nooren) teaches the mixing of bentonite clay with a hydrophobic substance such as bitumen or vaseline, with addition of only a small amount of water or alcohol, namely 0–4% (see column 4 line 44), to provide a sealing agent which is mouldable and useful for production of watertight bushings. Cellulose compounds or polyacrylates are mentioned as alternative water swellable or swollen high-molecular substances to the bentonite clay.

U.S. Pat. No. 5,132,021 (Alexander) is primarily concerned with use of dry, particulate bentonite clay sandwiched between outer sheets. At column 7, line 26 to 33 it mentions that polar activators such as 75–98% methanol or ethanol and 25–2% water can be "included with (absorbed by)" the clays, the amount of such activator being from 10–40% relative to the dry weight of the clay. Partial hydration of the clay should result from the aforesaid addition. However, there is no teaching at all of the mixing of the two constituents, or kneading same, to provide a substantially homogeneous deformable mass. Without this, a reliable waterproofing layer is not formed. The mere pouring of water onto the "in situ" dry clay will be quite inadequate in most applications, as discussed above.

U.S. Pat. No. 5,237,945 (White et al) teaches the application of a bentonite clay/water paste (preferably about 30% clay) to the top surface of a loose fibrous mat in which powdered clay has been deposited. The paste is subsequently compressed into the mat, which in practice is likely to prove difficult, and certainly will not provide a truly homogenous hydrated layer, nor retain or hydrate the loose particles.

Calcium montmorillonite is sometimes used as a substitute for sodium montmorillonite. In use, calcium bentonite, when initially wetted, will swell and expand in the same way as sodium montmorillonite. However, if the material should dry out, for example due to low rain fall or a falling water table calcium montmorillonite cannot shrink back to its original size upon loss of water without cracking. After cracking and upon re-wetting the clay can not re-wet so as to reform the waterproof barrier. Thus, a calcium bentonite waterproofing material should only be used in cases where permanent wetness is to be encountered.

All sodium containing montmorillonites do have a problem when the water which comes into contact with them is contaminated by salts, particularly sea water or other salts which render the ground water ionised and highly active. In ground water calcium is invariably present in quantity from soil and minerals. When such ionic calcium comes into contact with montmorillonite it tends to convert the montmorillonite from the sodium to the calcium form with the disadvantage which has been outlined above.

This particular process makes it generally unwise to use even sodium montmorillonite in a situation where the ground water can become rapidly ionised or contaminated by leachates or the like. In particular, fertilisers are a particularly notorious cause of ground water ionisation and can cause sodium montmorillonite break down.

In a paper entitled "Preparation of Montmorillonite—Polyacrylate Intercalation Compounds and the Water Absorbing Property" by Ogawa et al published in Clay Science Number 7 243 251 (1989), the authors have described the introduction of a acrylamide into montmorillonite and the polymerisation of the acrylamide to form a polyacrylamide intercalation compound. The enhanced water-absorbing properties of the compound are noted.

It is to be appreciated, of course, that the processes carried out in the Ogawa paper were essentially laboratory processes involving small amounts of material. No techniques were described for making any useful product and there was no discussion of the advantages of high density such compounds as waterproofing agents.

OBJECT OF THE INVENTION

It is an object of the present invention to provide a waterproofing material in sheet form whereby the above described disadvantages of mats incorporating dry or semi-hydrated particles (hydrated in situ), are reduced or minimised.

It is a further object to provide a waterproofing sheet which is reliably waterproof, and not subject to leakage in small local areas.

It is yet another object of the invention to provide a waterproofing material in sheet form which is less susceptible then hitherto to damage by leachates or salt water.

It is yet another object of the invention to provide a denser, and consequently less bulky and easier to handle waterproofing material in sheet form than hitherto.

SUMMARY OF THE INVENTION

The invention provides a novel method of making a waterproofing laminate material comprising the steps of mixing a particulate smectite clay with a liquid to form a mixture, said mixture containing clay in a range from 50% to 75% by weight and water in a range 10% to 30%, kneading said mixture in a high speed, high shear mixer to form a substantially homogeneous deformable mass, forming said mass by extrusion under vacuum into a waterproofing sheet, and laminating said sheet with a flexible, porous, carrier sheet to form a laminate structure free of loose particulate material In this respect, use of a mixer capable of high speeds and high shear action in order to thoroughly mix the liquid and granular components together and knead the resulting mixture is essential to ensure that a homogenous plastic (i.e deformable) mass is obtained .

Subsequent extrusion under vacuum is also essential to ensure removal of any potential air pockets in the mixture and a high density in the final product, which is desirably as thin as practical, so as to be as cost effective as possible.

In order to achieve an even pressure during extrusion, yet obtain a relatively wide, thin sheet of waterproofing material, it has been found particularly advantageous for the plastic mass to be extruded in annular form, using a conical, or bell shaped insert in the extrusion die, for example. Then, immediately after formation, the annulus or pipe can be slit, and supported as appropriate as it in uncurled and brought into contact with the carrier sheet.

After forming the laminate material can be subjected to a drying step to remove excess water from the waterproofing layer and cause it to loose a degree of elasticity so that it is less likely to deform further during transportation and storage. Such drying also increases the swellability of the smectite clay upon contact with water in use.

Union of the smectite containing layer with the carrier sheet can be by adhesive, but desirably no adhesive is used, the mixture of smectite (and other substance(s)) being such as to allow pressure to force the plastic mass into the interstices of the carrier sheet (which is desirably of a textile nature) so as physically to unite the two. Similar connection can be effected between the waterproofing layer and any overlying cover sheet.

Naturally, the invention also provides the waterproofing laminate material, free of loose particulate material, which results from the aforesaid method. Said material comprises a flexible, porous carrier sheet laminated to a waterproofing sheet which is formed by extrusion under vacuum from a substantially homogenous deformable mass consisting of a mixture of particulate smectite clay and a liquid, in which respect the clay is in a range from 50% to 75% by weight of the mixture and the liquid comprises water in a range from 10% to 30% by weight of the mixture.

Additives which modify the behaviour of the smectite clay under certain specified conditions such as salt water, or presence of strong leachates, radiation hydrocarbons or organic chemicals can be added at the mixing stage, particularly to the liquid component of the mixture, to be operative when the smectite is in use.

Organic materials such as methanol, ethanol and other alcohols, glycerine, diesel and other oils and fats can be added to the water.

Alcohols have particular advantages. The y are introduced primarily to increasing the flexibility and reducing the stiffness of the mixture thus assisting in its processing, i.e. a length of the clay can then be bent easily without breaking. Methanol and glycerol are particularly useful additives in this respect. Whilst alcohols are generally expensive, they are also usually far more volatile than water. Thus, a plastic mass made using methyl alcohol can, after having been formed into a cohesive continuous layer be dried using less heat than would be necessary to drive out the water from a similar mass. In addition to this however, the alcohol driven off can be condensed and reused thus offsetting the cost thereof.

The montmorillonite mesh size can be anything from 50 mesh or smaller, desirably, however the size is a maximum of 100. In practice a mesh size of 200 has been found useful although variations downwards from about 100 mesh do work although with less desirable qualities. Finer meshes are perfectly acceptable, but tend to be unnecessary. The smectite used is desirably sodium montmorillonite although calcium montmorillonite (modified by treatment with sodium hydroxide) can be used. As the montmorillonite is usually broken down significantly during mixing to micro sizes, initial grain size is not critical.

The waterproofing sheet may be sandwiched between the carrier sheet and cover sheet.

The fabrics used as carrier sheet and/or cover sheet can be conventional woven or non-woven textile such as nylon or polypropylene or polyester.

Waterproofing material in accordance with the invention can be used, for example, as roofing material or to provide a seal for a pipe or other plumbing fittings.

Acrylate or polyacrylate compounds may desirably be added to the liquid for mixing with the clay. In the sodium cation form the acrylate can replace the sodium cations which normally coat the outer layers of the smectite clay plates. These sodium ions are not readily displaced by calcium or other ions which may be present in leachate or fertilisers contaminated ground water, so that a highly effective barrier, which is resistant to breakdown is formed in this way.

Another advantage of incorporating acrylate or polyacrylate compounds is that adhesive compatible thereto, such as cyano acrylate adhesive, is effective to adhere the resulting sheet material to upright surfaces, such adhesion previously being rather difficult to accomplish due to the ineffectiveness of most adhesives.

A further problem of smectite clay when used as a waterproofing material, is that its function is very dependent on the amount of montmorillonite used. For example when a body of a montmorillonite is constrained between two surfaces, such as the concrete of a structure and the ground, when contacted by water it swells and forms a high pressure layer which prevents ingress of water to the structure and therefore effectively waterproofs it. To increase the waterproofing efficiency of the clay body, larger quantities of montmorillonite can be used. However, higher quantities of montmorillonite mean thicker sheets of material which are more difficult to handle and which are heavier gave more transportation costs and are bulky. In sheets which consist principally of particulate montmorillonite there can be significant difficulty in getting a large quantity into a small area. Sheet material used for waterproofing in ground situation or for roofs, walls and the like tend to have relatively low densities. This is because they are generally made from particulate montmorillonite adhered to a support sheet as of plastics material or textile material and secured thereto by a variety of means ranging from adhesive to needling to sewing or be embedment in a mesh of fibres.

The invention provides a smectite clay waterproofing material having a density greater than 1000 kg $m^{-3}$ (62.43 $lb/ft^3$).

The waterproofing material can be a sheet at least a meter (39.4 inches) wide and desirably up to four meters (157.5 inches) wide or more.

The pressure applied during extrusion, and after a suction treatment which has removed excess air and possible other gases, reduces the number of voids in the product as-well as urging the molecules of the product closer together to produce a denser product.

Reinforcement can be provided in the middle of the smectite containing layer.

The reinforcement can be secured to the cover sheet and/or the support sheet.

BRIEF DESCRIPTION OF THE DRAWINGS

The invention will be described further, by way of example, with reference to the accompanying drawings wherein.

DETAILED DESCRIPTION OF THE PREFERRED EMBODIMENTS

Figure 2:
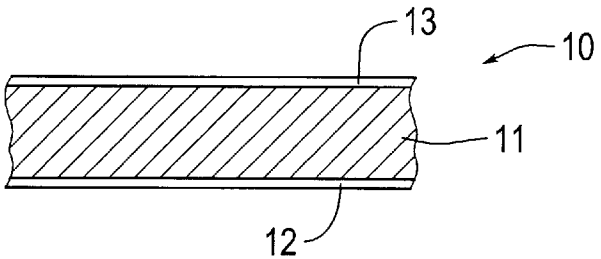
FIG. 2 is a cross-sectional view illustrating a preferred waterproofing material of the invention.

As shown in FIG. 2, the preferred waterproofing material (10) of the invention is a laminate consisting of a core layer (11) containing montmorillonite. The core layer (11) is united with a support sheet (12) and is desirably but not essentially overlaid by a cover sheet (13).

The essentials of the material (10) of the invention will probably be best apparent from a detailed description of the way it is made and the apparatus which is used to make it.

Figure 1:
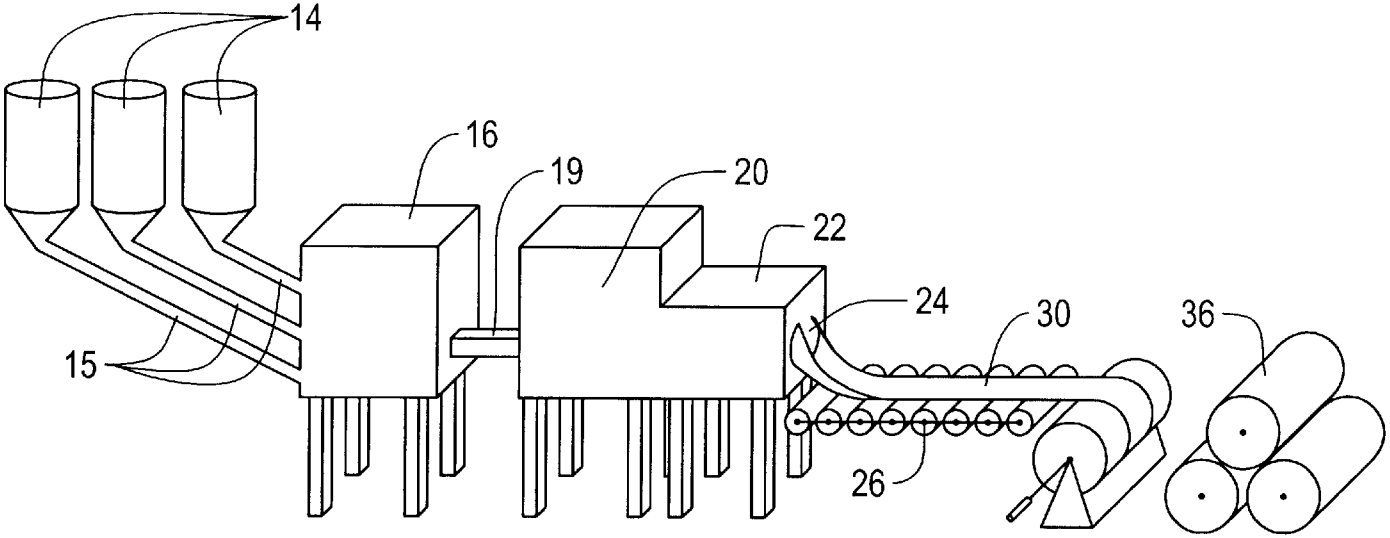
FIG. 1 is a schematic perspective view illustrating apparatus suitable for carrying out a preferred method of the invention.
Figure 3A:
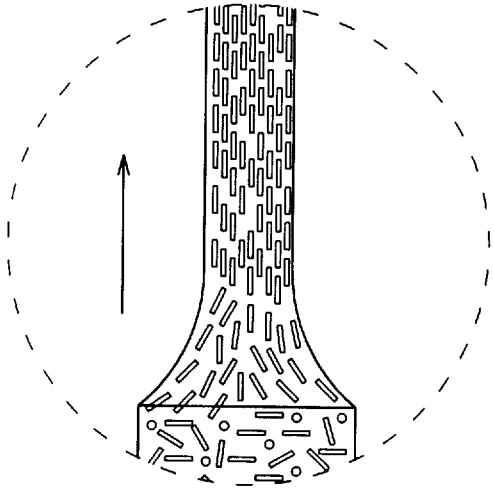
FIG. 3*a* is an enlargement of the encircled detail in FIG. 3.
Figure 3:
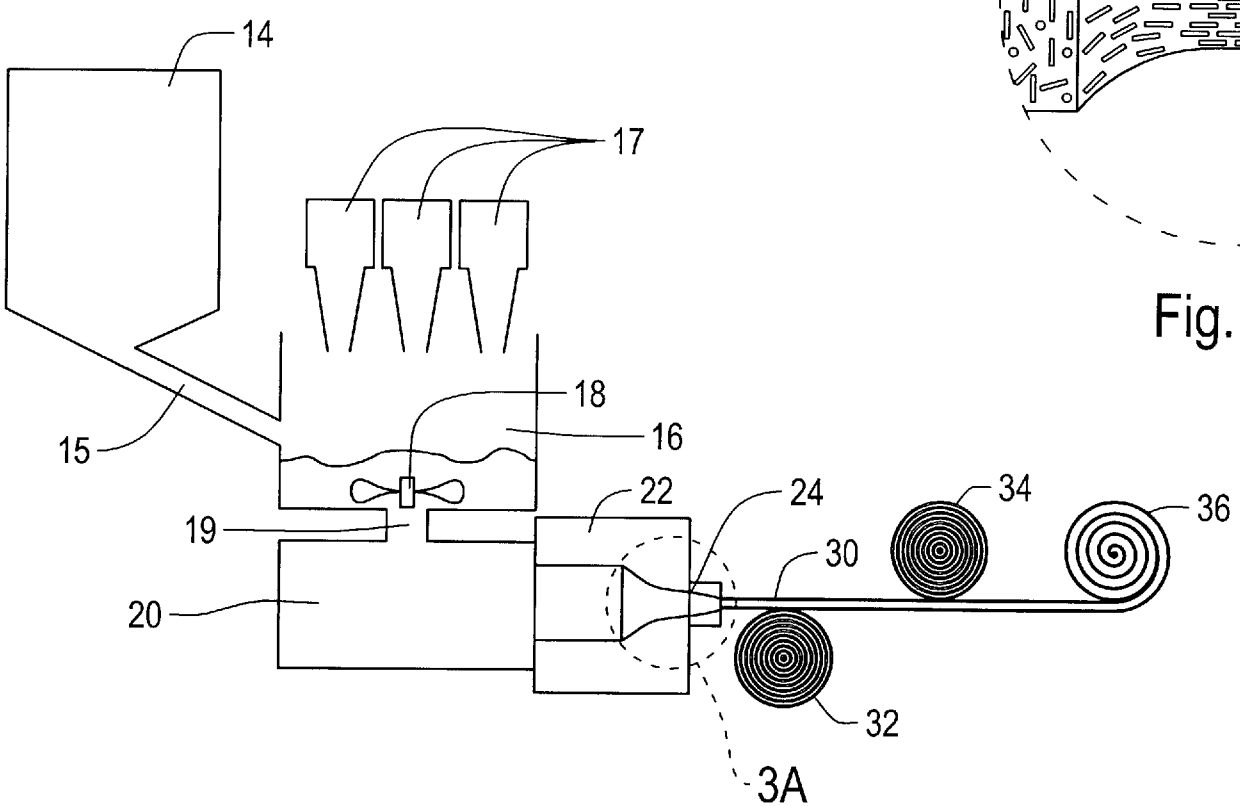
FIG. 3 is an enlarged schematic side view also illustrating how the method of the invention is carried out using the apparatus of FIG. 1.

Referring, therefore, to FIGS. 1 and 3, it will be seen that preferred apparatus of the invention comprises one or more silos (14) containing particulate sodium bentonite clay linked by respective feeder pipes (15) to a high speed, high shear mixer (16). Supply means for liquid components, namely water into which other constituents, such as alcohol, polyacrylates, carboxymethyl cellulose, have been dissolved, takes the form of tanks or nozzles (17) leading into the mixer (16). A mixing paddle (18) is shown diagrammatically in FIG. 3. The mixer (16) is connected by a duct (19) to an extruder (20) which includes a vacuum chamber (22). Within the extruder, there is a cavity for receiving a deformable mass, which reduces in dimension from the end adjacent the inlet duct (19) to the outlet at die (24).

The aforesaid cavity is divided into two compartments by a perforated partition (not shown). A conventional worm or screw extends the length of the cavity, including through the partition and serves to convey the kneaded mixture received the mixer (16) through to the die (24). As the material is forced through the apertures of the partition it is further mixed and compressed. The tapering shape of the cavity contributes to compression of the material, which is then subject to suction (vacuum) as it approaches the die (24). This removes any air trapped or potentially trapped within the mixture so as to avoid any gap or weakness in the eventual waterproof sheet.

The die (24) is formed with a circular aperture and fitted with a conical or bell shaped insert so that the material is extruded in annular form, as shown in FIG. 1. This believed to be the most effective way of obtaining an even pressure across a distance of anything from 1 to 4 m (approximately 3.25 to 13.0 feet) and obtaining a pipe having a diameter of between 30 and 170 cm and a thickness between 4 and 6 mm. The resulting pipe of extruded material is immediately slit at the top, as indicated in FIG. 1, by positioning a knife or blade at that position, adjacent the die (24). The material (30) is then supported upon rollers as it is gradually uncurled and lowered onto a roller conveyor (26).

Support and cover sheets (32, 34) of geotextile material (woven or non-woven) are brought into engagement with the waterproofing sheet (30) as indicated in FIG. 3. Their adhesion to the waterproofing material (30) may be enhanced by passing between one or more pressure nips (not shown), as this will more reliably embed the fabric of the sheets (32) and/or (34) into the deformable waterproofing layer (30).

The final laminate is formed into a roll (36) ready for storage or transportation.

As shown in FIG. 3*a*, the particles of partially hydrated bentonite clay and to come into alignment as the degassed homogenised material is forced through the die (24). The support sheet (32) is preferably a sheet of woven material which is relatively loose weave, being quite porous in a direction transverse to its plane. It can be made of any geotexile material which is suitable for disposal within the ground for long periods. Typical materials for weaving or forming the fabric of the sheet (32) can be polypropylene, polyesters including nylon, and many other plastics materials alone or in blends. The material should be sufficiently strong to support the composite laminate to be formed and can be similar to many of the facing sheets used in relation to the prior known materials discussed in the introduction hereto. Polypropylene and cotton mixers can also be used. A typical support and/or cover sheet can be of a print weave and of a weight from 30 to 2000 g per square meter.

The particulate montmorillonite can be supplied to the hopper (14) from a mill or like supply and in the preferred embodiment is of 200 mesh. Finer mesh can be sued although great advantages are not obtained. Meshes up to 50 mesh can be used, but at sizes greater than 100 mesh, union between the montmorillonite particles is less effective.

The process which takes place in the mixer (16) can be either a continuous or a bath process. Within the mixer (16) a measured quantity (i.e. weight) or montmorillonite is mixed with a measured quantity of liquid from the tanks (17) to produce a shapable mass.

In making a typical product in accordance with the invention 5 kilogrammes of montmorillonite were mixed with 0.446 kilogrammes of sodium carboxymethyl cellulose (CMC), 2.5 liters of methanol and 1.8 liters of water. Both the CMC and the methanol make the mixed and kneaded product more flexible and extrudable.

Although the above particular mixtures have proved suitable many variations can be made.

Methanol alone or water alone can be used, but neither of these is satisfactory.

The material desirably contains a bulking agent, an anti-fungicidal preserving agent, to prevent growth of mould in or on the material and desirably a lubricant to assist in the extrusion process and provide a degree of flexibility to the plastic mass. CMC is a very desirable substance in that it provides all these properties. It has anti-fungicidal properties, it is a lubricant and it makes the product more flexible. It also has the great advantage that upon contact by water, in use, it dissolves. Those areas of the outer surface of the material when first contacted by water have the CMC dissolved out of them leaving micro pores into which more water can penetrate, wash out more CMC and cause rapid expansion of the adjacent montmorillonite.

This greatly increases the rate of water transfer into the material. A bulking agent which dissolves in water and aids water ingress to the montmorillonite is very desirable.

Instead of being provided by a single material these properties can be provided by other materials. Although many synthetic materials do have these properties, they tend to be expensive and simple plat extracts which are much cheaper than desired. As a bulking agent/lubricant guargum can be used or starch. In connection with these two materials a separate preservative such as any conventional anti-fungicidal or anti-microbial agent would have to be used.

Any convenient liquid alcohol can be used having from 1 to 12 carbon atoms. Above C12 alcohols tend to be too viscose for use but below that number any convenient alcohol can be used. It is expected, however, that methyl alcohol will be used because of its cheapness and easy availability. The CMC can be in the form of sodium carboxy methyl cellulose or any other convenient compound thereof. Protection against bacterial attack is important because the bacterial reactions can produce hydro carbons which react with the sodium ions in the clay. This can reduce the swellability of the clay.

The montmorillonite used is desirably sodium montmorillonite but calcium montmorillonite or treated calcium montmorillonite and other smectites can also be used.

Figure 4:
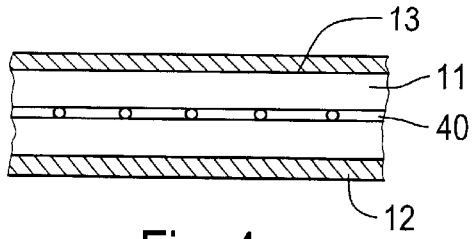
FIG. 4 is a view similar to FIG. 2 but illustrating a modified material of the invention.
Figure 5:
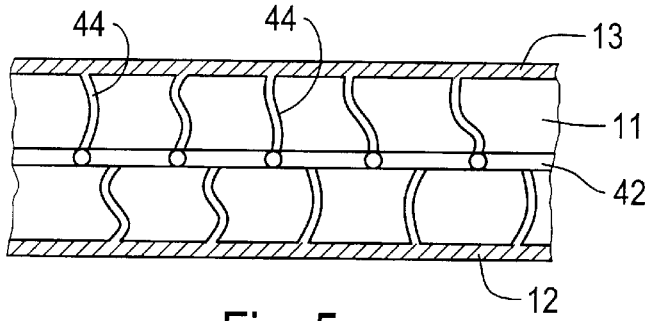
FIG. 5 is a view similar to FIG. 4 but illustrating a still further modified material.

If reinforcement is required within the montmorillonite layer in order that it can be laid on steep slopes without loss of function it can be desirable to incorporate a reinforcing layer within the plastic mass, as shown in FIGS. 4 and 5. This can be done by embedding a reinforcing layer (40) into the mass (11) as it is being extruded, the result being shown in FIG. 4. In this respect, it must be mentioned that the plastic mass of waterproofing material can be extruded as a sheet, rather than a pipe which is slit to form a sheet, within the scope of the invention, although extrusion as a sheet does not produce such a good evenly spread layer when such a wide sheet is required.

The reinforcing layer can be made in the form of a core (42) having bristles (44) or comparable formations extending outwards, as shown in FIG. 5, which, with the cored (42) disposed centrally in the body of montmorillonite (11), extend to the surface thereof and contact and possibly project through the surface layers (12, 13). The material of the reinforcement and the surface layers can be made such that the exposed bristles can be heat sealed to contact and be secured to the outer layers. It is envisaged that it would be possible for the montmorillonite mass to be extruded or formed into a pair of sheets and the reinforcement fed between them and to have its bristles projecting through each of the two part layers of the montmorillonite core and project to the other surfaces thereof and be united with the support/cover sheets.

The substance which convert the powdered montmorillonite into a plastic fluent mass may need some degree of treatment, for example by evaporation, drying or partial chemical change to ensure that the final material cannot deform further in use or in storage. This can be effected by means of a treatment facility (not shown) which the finished laminate is passed through.

When the liquid in the mixture is essentially water or an evaporable liquid the treatment facility will be in the form of an oven and it may reduce the solvent water convent of the montmorillonite containing layer from 20% down to 5% or less.

After leaving the treatment facility the laminate can be allowed to cool and then be fed to a store roll in conventional manner. A knife or the like can be provided for cutting the laminate as it leaves the oven when the roll is full.

As previously mentioned, the laminate may be passed between one or more pairs of rollers to cause the support/cover sheets (32, 34) to be partially embedded in surface zones of the plastic mass of material forming the core (11) whilst the core is in a plastic state. There is no need for any adhesive, which is an expensive and unreliable component.

If the core is treated, either by evaporation or chemically so as to cause the core to harden, there is a physical locking of the surface portions of the core (11) with portions of the fabrics (32, 34) physically uniting them to the surface without the need for adhesive.

This has two important consequences.

Firstly, because a good portion of the sheets (32, 34) are embedded within the material of the core, only a small portion of the body of the fabric is exposed above the surface. Thus, in use that fabric surface will be in contact either with anchoring overburden (at least 150 mm of overlying material is recommended to protect such layers) or the underlying earth. The overburden or the earth penetrates the fabric quite easily (it is a very open fabric and after there is intimate contact between the overburden and the underlying earth). This again has two important consequences. Firstly, once the support layer (32) (which will normally be in contact with underlying earth) is intimately connected by the earth ground water enters contacts the montmorillonite and causes swelling which creates a seal.

It is a further advantage that because of the intimate contact of the underlying soil or the overburden with the montmorillonite through the support and cover sheets (32, 34) there is no possibility that either the cover sheet (34) or the support sheet (32) can allow any venting of gas laterally through the fabric.

Figure 6:
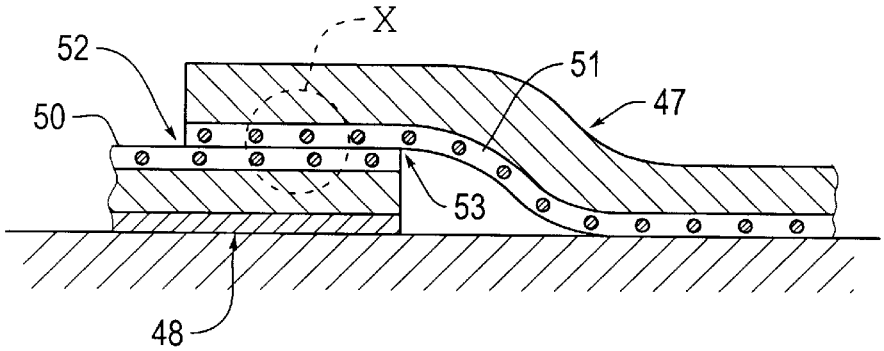
FIG. 6 is a cross-sectional view illustrating an overlap joint made using material of the present invention similar to that shown in FIG. 2.
Figure 7:
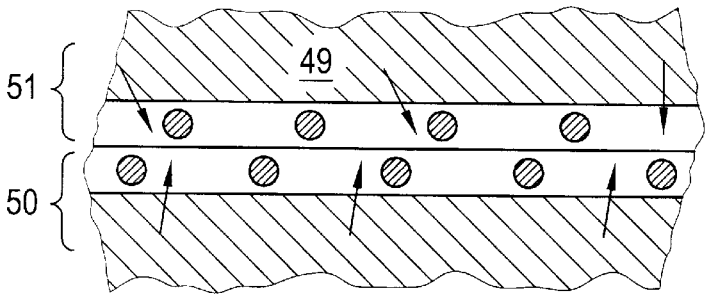
FIG. 7 is an enlarged view of the portion ringed at numeral X in FIG. 6.

The second advantage of this is illustrated in FIGS. 6 and 7. In FIG. 6 a first piece (47) of the laminate material of the invention is shown overlapping a lower piece (48), both lying on the ground (49). The overlap cover sheet (50) of the second sheet (48) is in contact with the support sheet (51) on the piece (47). As illustrated in FIG. 7 the sheets (50) and (51) are in intimate contact and they are significantly penetrated by montmorillonite from the respective cores of the two laminate sheets. Upon entry of water in the direction of arrow (52) or (53) the montmorillonite in one or each of the cores can swell and expand into the unfilled portions of the fabric (50, 51) and forming effectively a continuous layer of expanded montmorillonite uniting the two cores and providing a completely water tight seal.

The invention is not limited to the precise details of the foregoing and variations can be made thereto.

As well as montmorillonite, saponite and other smectites can be used.

In carrying out a preferred process a batch of about 60 kilogrammes was prepared, the figures given in the following being percentage by weight for the various components.

Firstly, 25% water was added to a mixer, followed by 16% sodium polyacrylate. To these was added 5% methyl alcohol. When these three had been mixed half of the total bentonite load of 63% was added. Once the mixture had become smooth 1% carboxy methyl cellulose (CMC) and a small (about 0.1%) of sodium hexametaphosphate was added. Both these materials were added slowly and after they had been added the mixture was stirred for some while. Thereafter the other half of the bentonite was added, the mixture kneaded for a short time and then passed to an extrusion machine wherein it was first driven towards a perforated plate whence it emerged in vermicelli-like form into a vacuum chamber. In the vacuum chamber air and any other gases such as reaction products and probably some evaporated alcohol are extracted.

The material is then driven towards an extrusion head.

The percentages of the various materials used can be varied as follows:

| ITEM | PERCENTAGE RANGE (BY WEIGHT) |
|---|---|
| Water | 15–25 |
| Sodium Polyacrylate | 8–16 |
| (Methyl) Alcohol | 0–5 |
| Wyoming Bentonite | 50–75 |
| Carboxy Methyl Cellulose | 0–3 |
| Sodium Hexameta Phosphate | 0–0.5 |

The function of the pressure during extrusion is to increase the density of the product by eliminating voids which might otherwise form within a less than coherent mass. This, together with the vacuum step which has removed air has the effect of compressing the material to a high density. This moves the molecules slightly closer together during extrusion thus increasing the rate of reaction and encouraging the formation of a complex from the intercalated polyacrylate. Desirably the density is greater than 1,000 kilogrammes per meter$^3$ (62.43 lb/ft$^3$) and a preferred density is over 1,300 kilogrammes per meter$^3$.

The process described above produces a sheet material which can be used to form an ideal barrier against aggressive ionised fluids. Such ionised fluid will usually be leachates from plants or sites or may be atmospheric water or ground water contacting the capping of a landfill site. It has been found that fertiliser and other materials which may be applied to foliage above a landfill site forms a highly ionised material as aggressive as any leachate and which can seriously damage conventional bentonite liners.

The material referred to above has the acrylate or other liner so securely attached to the bentonite interlayers that the cation exchange capacity (CEC) of the material is nil or very low. This means that there is no possibility of the smectite turning to a calcium form which will not reswell after drying out. Further, as the liner is preferably a plastics material the inherently stable nature of the polymeric plastics material makes the possibility of it being attached by leachate or strong solutions quite remote.

What is claimed is:

1. A waterproofing laminate material free of loose particulate material consisting essentially of:

a flexible, porous carrier sheet laminated to a waterproofing sheet which is formed by extrusion under vacuum from a substantially homogenous deformable mass consisting of a mixture of particulate smectite clay and a liquid, in which respect the clay is in a range from 50% to 75% by weight of the mixture and the liquid comprises water in a range from 10% to 30% by weight of the mixture.

2. A waterproofing laminate material as claimed in claim 1 wherein said liquid in said mixture further comprises an alcohol having 1–12 carbon atoms.

3. A laminate material as claimed in claim 2, wherein said alcohol is methanol, ethanol or propanol.

4. A laminate material as claimed in claim 1, wherein said liquid in said mixtures also contains acrylate or polyacrylate.

5. A laminate material as claimed in claim 1, wherein said liquid in said mixtures also contains glycerol.

6. A laminate material as claimed in claim 1, wherein said liquid in said mixture also contains a carboxymethyl cellulose (CMC) compound.

7. A laminate material as claimed in claim 1, wherein said waterproofing sheet is sandwiched between said support sheet and a cover sheet.

8. A laminate material as claimed in claim 1 wherein reinforcement is provided in said waterproofing sheet.

9. A laminate material as claimed in claim 8 wherein said reinforcement is secured to said support sheet.

10. A laminate material as claimed in claim 7 wherein reinforcement is provided in said waterproofing sheet and is secured to said cover sheet.

11. A laminate material as claimed in claim 7 wherein said waterproofing sheet has a density greater than 1000 kg $m^{-3}$ (62.43 lb/$ft^3$).

12. A waterproofing laminate material as claimed in claim 1 wherein said waterproofing sheet is less than 1 cm (0.4 inches) thick.

13. A waterproofing laminate as claimed in claim 1 wherein said waterproofing sheet is between 4 mm and 6 mm (0.15 and 0.25 inches) thick.

14. A waterproofing laminate material as claimed in claim 1 wherein said waterproofing sheet is between 1 m and 4 m (39.4 and 157.5 inches) wide.

15. A method of making a waterproofing laminate material consisting essentially of the steps of mixing a particulate smectite clay with a liquid to form a mixture, said mixture containing clay in a range from 50% to 75% by weight and water in a range 10% to 30%, kneading said mixture in a high speed, high shear mixer to form a substantially homogeneous deformable mass, forming said mass by extrusion under vacuum into a waterproofing sheet, and laminating said sheet with a flexible, porous, carrier sheet to form a laminate structure free of loose particulate material.

16. A method of making a waterproofing laminate material as claimed in claim 15 wherein said mass is extruded in annular form, and then slit to provide said waterproofing sheet.

17. A method of making a waterproofing laminate material as claimed in claim 15 wherein said mass is extruded as a pipe having a diameter in the range 30 to 170 cm (11.8 to 66.9 inches) and a thickness less than 1 cm (0.4 inches) and is slit immediately after extrusion to provide said waterproofing sheet.

18. A method as claimed in claim 15 which comprises treating said waterproofing sheet united with said carrier sheet to cause said waterproofing sheet to lose a degree of plasticity.

19. A method as claimed in claim 18, wherein said treatment comprises subjecting said continuous waterproofing sheet to a drying step by passing said laminate material through an oven to remove liquid from said waterproofing sheet by evaporation.

20. A method as claimed in claim 15 wherein said continuous waterproofing sheet is united with said support sheet by adhesive.

21. A method as claimed in claim 15 wherein said continuous waterproofing sheet and said support sheet are physically united.

22. A method as claimed in claim 15 wherein alcohol is used as part of the liquid.

23. A method as claimed in claim 22 wherein some of the alcohol is removed from the continuous waterproofing sheet united with said support sheet and recycled.

24. A waterproofing material free of loose particulate material, consisting essentially of a waterproofing sheet which is formed by extrusion under vacuum from a substantially homogeneous deformable mass consisting of a mixture of particulate smectite clay and a liquid, in which respect the clay is in a range from 50% to 75% by weight of the mixture and the liquid comprises water in a range from 10% to 30% by weight of the mixture.

25. A waterproofing material free of loose particulate material, consisting essentially of a waterproofing sheet which is formed by extrusion under vacuum from a substantially homogeneous deformable mass consisting of a mixture of particulate smectite clay and a liquid, in which respect the clay is in a range from 50% to 75% by weight of the mixture and the liquid comprises water and an organic material in a range from 10% to 30% by weight of the mixture.

* * * * *